US005739640A

United States Patent [19]

Noble

[11] Patent Number: 5,739,640

[45] Date of Patent: Apr. 14, 1998

[54] LOW LINE VOLTAGE DETECTION CONTROL MODULE AND METHOD FOR A FLUORESCENT LAMP

[75] Inventor: Glenn A. Noble, Nampa, Id.

[73] Assignee: Beacon Light Products, Inc., Meridian, Id.

[21] Appl. No.: 569,850

[22] Filed: Dec. 8, 1995

[51] Int. Cl.[6] ..... H05B 37/00

[52] U.S. Cl. ..... 315/119; 315/106; 315/107; 315/308

[58] Field of Search ..... 315/119, 308, 315/102, 105, 106, 107, DIG. 7, 307

[56] References Cited

U.S. PATENT DOCUMENTS

| | | | |
|---|---|---|---|
| 4,329,627 | 5/1982 | Holmes | 315/209 R |
| 4,870,340 | 9/1989 | Kral | 323/235 |
| 5,030,890 | 7/1991 | Johnson | 315/208 |
| 5,089,753 | 2/1992 | Mattas | 315/324 |

FOREIGN PATENT DOCUMENTS

| | | |
|---|---|---|
| 46395 | 2/1982 | European Pat. Off. . |
| 197035 | 10/1986 | European Pat. Off. . |
| 471215 | 2/1992 | European Pat. Off. . |
| 471332 | 2/1992 | European Pat. Off. . |
| 2517211 | 10/1976 | Germany . |
| 9535646 | 12/1995 | WIPO . |

OTHER PUBLICATIONS

Co-pending Patent Application—U.S. application No. 08/258.007; Attorney Docket No. (083-309); filed Jun. 10,1994.

Co-pending Patent Application—U.S. application No. 08/257,899; Attorney Docket No. (083-310); filed Jun. 10, 1994.

Co-pending Patent Application—U.S. application No. 08/040,880; Attorney Docket No. (083-321); filed Mar. 16, 1995.

*Primary Examiner*—Robert Pascal
*Assistant Examiner*—Arnold Kinkead
*Attorney, Agent, or Firm*—John R. Ley

[57] ABSTRACT

The present invention discloses a control module that provides improved control over the ignition of a fluorescent lamp. In one aspect, the control module determines whether the lamp is lit and, when the lamp is not lit, determines whether the power supply line voltage is insufficient to sustain the lamp in a lit state after ignition. When the power supply line voltage is determined to be insufficient, the control module waits until the power supply line voltage rises to a sufficient level before igniting the lamp.

20 Claims, 3 Drawing Sheets

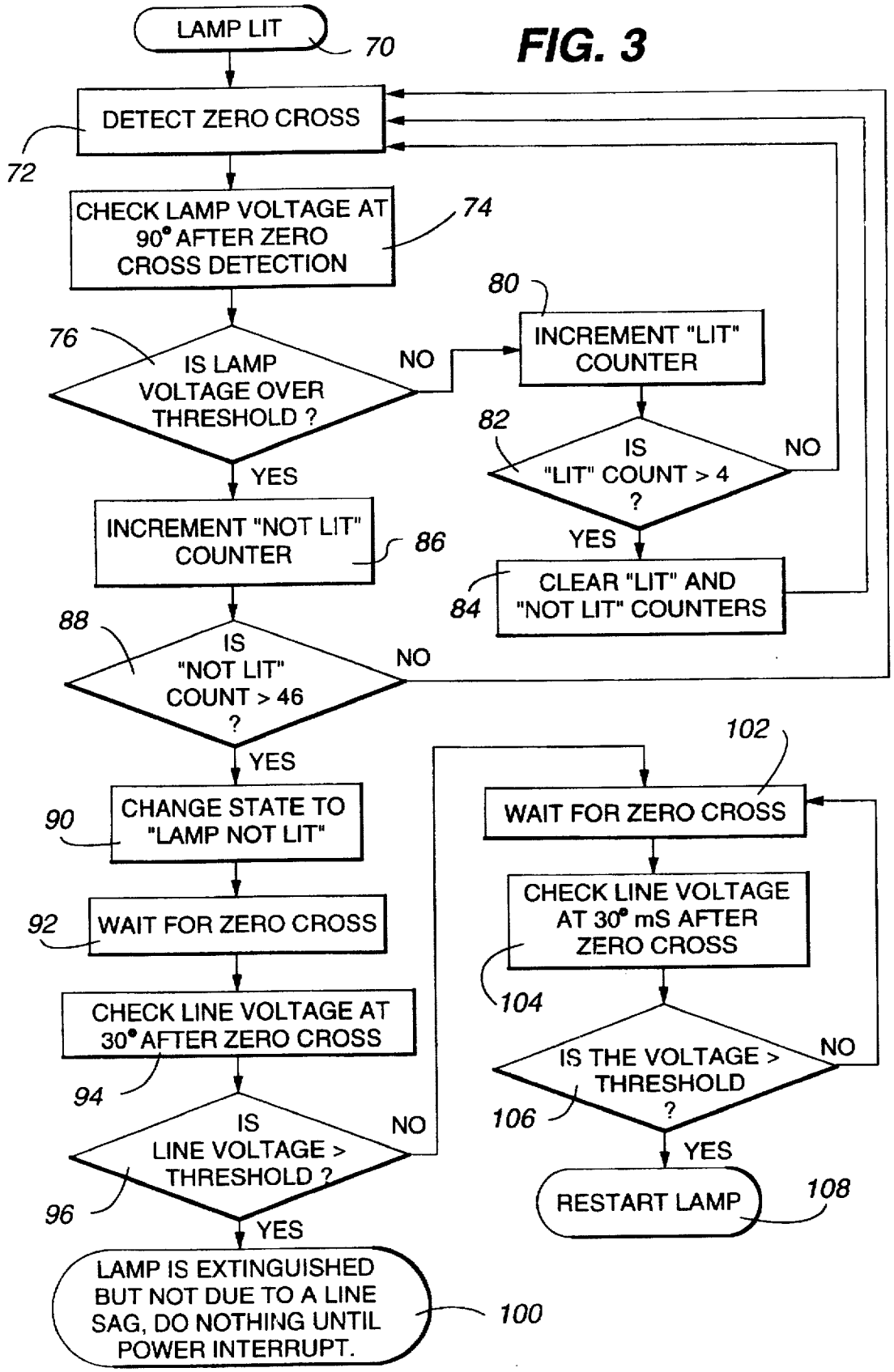
FIG. 3
LAMP LIT
70
DETECT ZERO CROSS
72
CHECK LAMP VOLTAGE AT 90° AFTER ZERO CROSS DETECTION
74
76
IS LAMP VOLTAGE OVER THRESHOLD ?
NO
YES
80
INCREMENT "LIT" COUNTER
82
IS "LIT" COUNT > 4 ?
NO
YES
84
CLEAR "LIT" AND "NOT LIT" COUNTERS
INCREMENT "NOT LIT" COUNTER
86
88
IS "NOT LIT" COUNT > 46 ?
NO
YES
90
CHANGE STATE TO "LAMP NOT LIT"
92
WAIT FOR ZERO CROSS
CHECK LINE VOLTAGE AT 30° AFTER ZERO CROSS
94
IS LINE VOLTAGE > THRESHOLD ?
NO
96
YES
LAMP IS EXTINGUISHED BUT NOT DUE TO A LINE SAG, DO NOTHING UNTIL POWER INTERRUPT.
100
102
WAIT FOR ZERO CROSS
CHECK LINE VOLTAGE AT 30° mS AFTER ZERO CROSS
104
IS THE VOLTAGE > THRESHOLD ?
NO
106
YES
RESTART LAMP
108

LOW LINE VOLTAGE DETECTION CONTROL MODULE AND METHOD FOR A FLUORESCENT LAMP

CROSS REFERENCE TO RELATED APPLICATION

Information regarding the starter which is advantageously used in an embodiment of the present invention is discussed in the U.S. Patent Application for "Voltage-Comparator, Solid-State, Current-Switch Starter for Fluorescent Lamp", filed Jun. 10, 1994, Ser. No. 08/258,007 assigned to the Assignee hereof, ("the '007 Application"), now U.S. Pat. No. 5,537,010. The information relating to this starter is incorporated herein by this reference.

1. Field of the Invention

The present invention relates to lighting, and more particularly to a new and improved apparatus for controlling a fluorescent lamp to achieve improved control over the ignition of the lamp. More particularly, the present invention relates to a controller that determines whether the lamp is lit and, when the lamp is not lit, determines whether the power supply line voltage is insufficient to sustain the lamp in a lit state. Furthermore, the controller delays ignition of the lamp until the power supply line voltage is sufficient to sustain the lamp in a lit state.

2. Background of the Invention

There are many desirable features associated with fluorescent lamps, compared to incandescent lamps. For example, fluorescent lamps typically use substantially less electrical power and produce equal or greater illumination. The lower power consumption is desirable to all users but is particularly important in those areas of the world with insufficient power generation capacity.

One of the difficulties associated with fluorescent lamps is starting or igniting them. Starting the lamp requires both a separate starter and the coalescence of various factors including the instantaneous voltage, timing and temperature, all of which have been discussed more completely in the '007 Application referenced above. A limitation of known starters, including the starters described in the '007 Application, is that if the lamp should become unlit and is unable to relight, the starter will either continuously attempt to relight the lamp or will not detect that the lamp is unlit and will leave the lamp in the unlit state. If the lamp is unable to be relit for an extended period of time and the starter continuously attempts to relight the lamp, the starter will waste a substantial amount of electrical power as heat and, relatedly, will cause premature failure of the lamp, starter, and associated electrical circuitry.

It is with respect to this and other background information that the present invention has evolved.

SUMMARY OF THE INVENTION

One aspect of the present invention is the use of a control module that functions to determine whether the lamp is lit and, in response to determining that the lamp is not lit, functions to determine whether the lamp is unable to be sustained in a lit state. Another aspect of the invention relates to controlling the restarting of the lamp to avoid restarting when the lamp is unable to be sustained in a lit state. Still another aspect of the present invention is determining when the lamp has become unlit due to an insufficient AC line voltage from a power source, monitoring the AC line voltage while it is low, and restarting the lamp when the AC line voltage is sufficiently high to maintain the lamp in a lit state.

In accordance with these and other aspects, a control module of the present invention is used with a fluorescent lamp which has cathodes and a medium which is ionizable into a conductive plasma and which has a characteristic ionization voltage when the medium is ionized. The cathodes are energized by an alternating (AC) power source which provides alternating half cycles of AC line voltage and AC line current to the lamp cathodes. The control module includes a lamp monitoring circuit that determines whether the medium of the lamp is ionized. The control module further includes a line voltage monitoring circuit that determines whether the AC line voltage from the AC power source is less than a predetermined line voltage threshold above the characteristic ionization voltage of the medium. The lamp is unable to be sustained in a lit state when the AC line voltage is less than the predetermined line voltage threshold above the characteristic ionization voltage of the medium.

Some additional features of the invention include the following: The control module includes a starter circuit which is triggered to restart the lamp when the line voltage monitoring circuit determines that the AC voltage from the AC power supply is at least equal to the predetermined line voltage threshold above the characteristic ionization voltage of the medium. The control module determines that the medium is non-ionized by determining that the voltage across the cathodes exceeds the characteristic ionization voltage of the medium by a predetermined lamp voltage threshold. The lamp monitoring circuit and the line voltage monitoring circuit sample the voltage across the cathodes at a first predetermined sample time and a second predetermined sample time, respectively, after the zero crossing point of a half-cycle of the AC line voltage from the AC power source and compare the sample voltages to a first reference voltage and a second reference voltage, respectively. Importantly, the first and second reference voltages are made substantially the same by selecting the first and second predetermined sample times according to the disclosed relationships.

A more complete appreciation of the present invention and its scope can be obtained by reference to the accompanying drawings, which are briefly summarized below, the following detailed description of presently preferred embodiments of the invention, and the appended claims.

BRIEF DESCRIPTION OF THE DRAWINGS

FIG. 3 is a flowchart of the operations performed by a controller of the control module shown in FIG. 1 according to the present invention.

DETAILED DESCRIPTION

Figure 1:
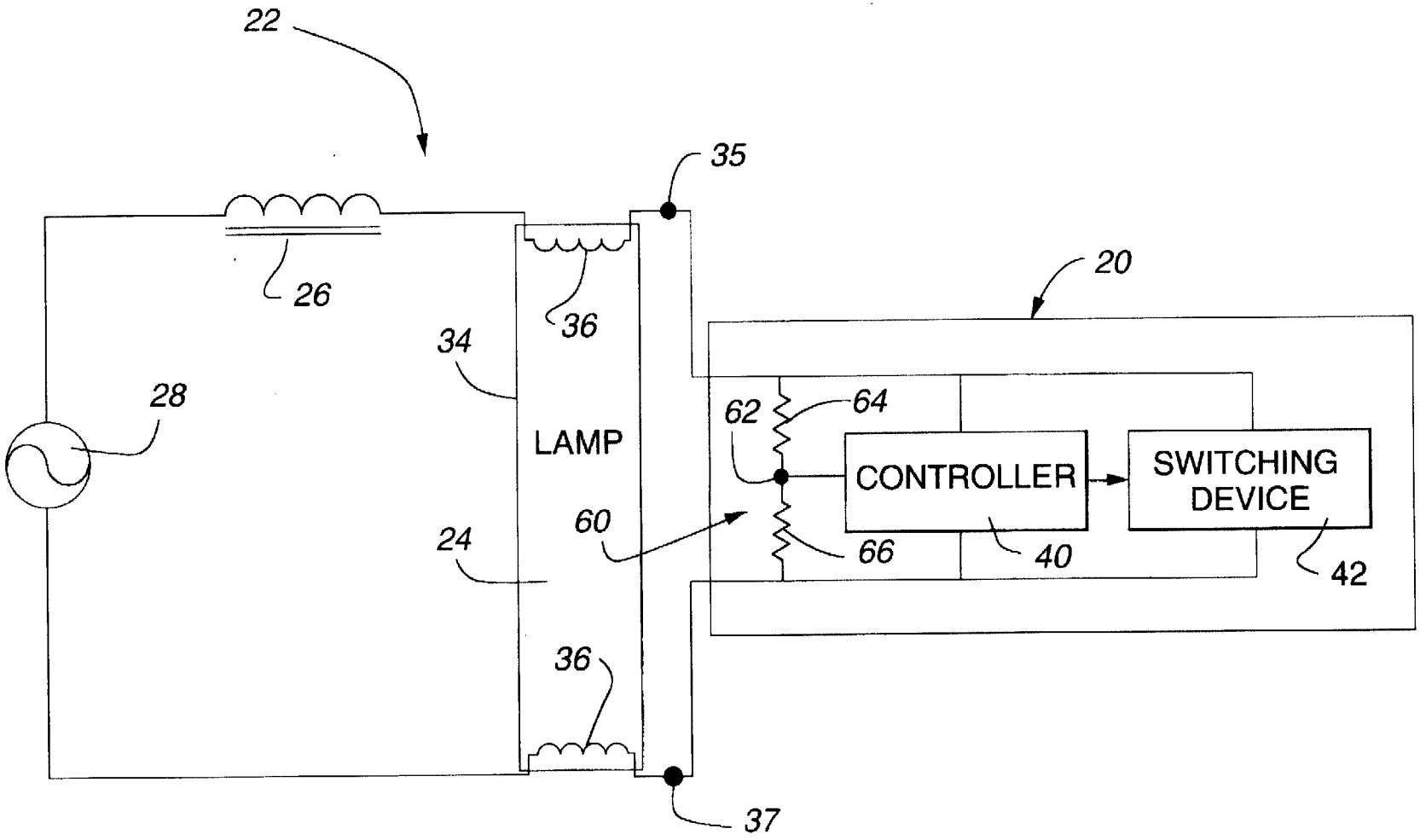
FIG. 1 is a simplified circuit diagram of a conventional AC power source, a fluorescent lamp, a ballast, and an improved control module for monitoring the status of the lamp and controlling restarting of the lamp according to the present invention.

The features of the present invention are preferably embodied in a control module 20 which is connected as a part of an otherwise-typical fluorescent lamp circuit 22 shown in FIG. 1. A fluorescent lamp 24 is connected in series with a current limiting inductor 26 known as a ballast. A conventional source 28 applies an alternating line voltage and current to the series connected lamp 24 and ballast 26.

The fluorescent lamp 24 is formed generally of an evacuated translucent housing 34 which has two filament electrodes known as cathodes 36 located at opposite ends of the housing 34. A small amount of mercury is contained within the evacuated housing 34. With the lamp 24 lighted, the mercury is vaporized and ionized into a conductive medium, and current is conducted between the cathodes 36 through the mercury medium creating a plasma. The light energy from the plasma creates the illumination. Due to the conductivity characteristics of the plasma medium, the ballast 26 is necessary to limit the current flow through the plasma to prevent the cathodes 36 from burning out.

The control module 20 is connected in series with and between the cathodes 36 at terminals 35 and 37. The control module 20 includes functional elements similar to those described in the '007 Application as well as those described below. The control module 20 includes a controller 40 and a switching device 42. The switching device 42 is connected in series with the ballast 26 and the cathodes 36. To light the lamp 24, the controller 40 closes the switching device 42 to establish a closed series circuit between the cathodes 36 for a warm-up time period during which AC line current from the source 28 flows through both cathodes 36 thereby heating the cathodes. The heat from the cathodes 36 helps vaporize the mercury within the housing 34. The heated cathodes 36 also emit low work energy ions from a barium coating on the surface of the cathodes to further assist in establishing the ionized medium within the housing 34.

After the warm-up time period, the controller 40 opens the switching device 42 to ignite or start the lamp 24 during a relatively short ignition time period. The unique characteristics of a thyristor preferably contained in the switching device 42 (described in the '007 Application) cause an almost instantaneous termination of the current flow through the switching device 42 when the AC current is at a significantly high value, resulting in a relatively high change in current in a relatively short amount of time (di/dt). The ballast 26 responds to the relatively high di/dt by producing a very high voltage ignition pulse which appears across the cathodes 36 and the non-conductive switching device 42. The voltage of the ignition pulse is sufficiently high to break down the partially ionized mercury vapor within the lamp housing 34, causing a plasma arc to extend directly between the cathodes 36 since the switching device 42 is non-conductive and no longer presents a current path between the cathodes 36. The current between the cathodes more completely ionizes the mercury medium in the housing 34, and the energized plasma creates the illumination.

Figure 2:
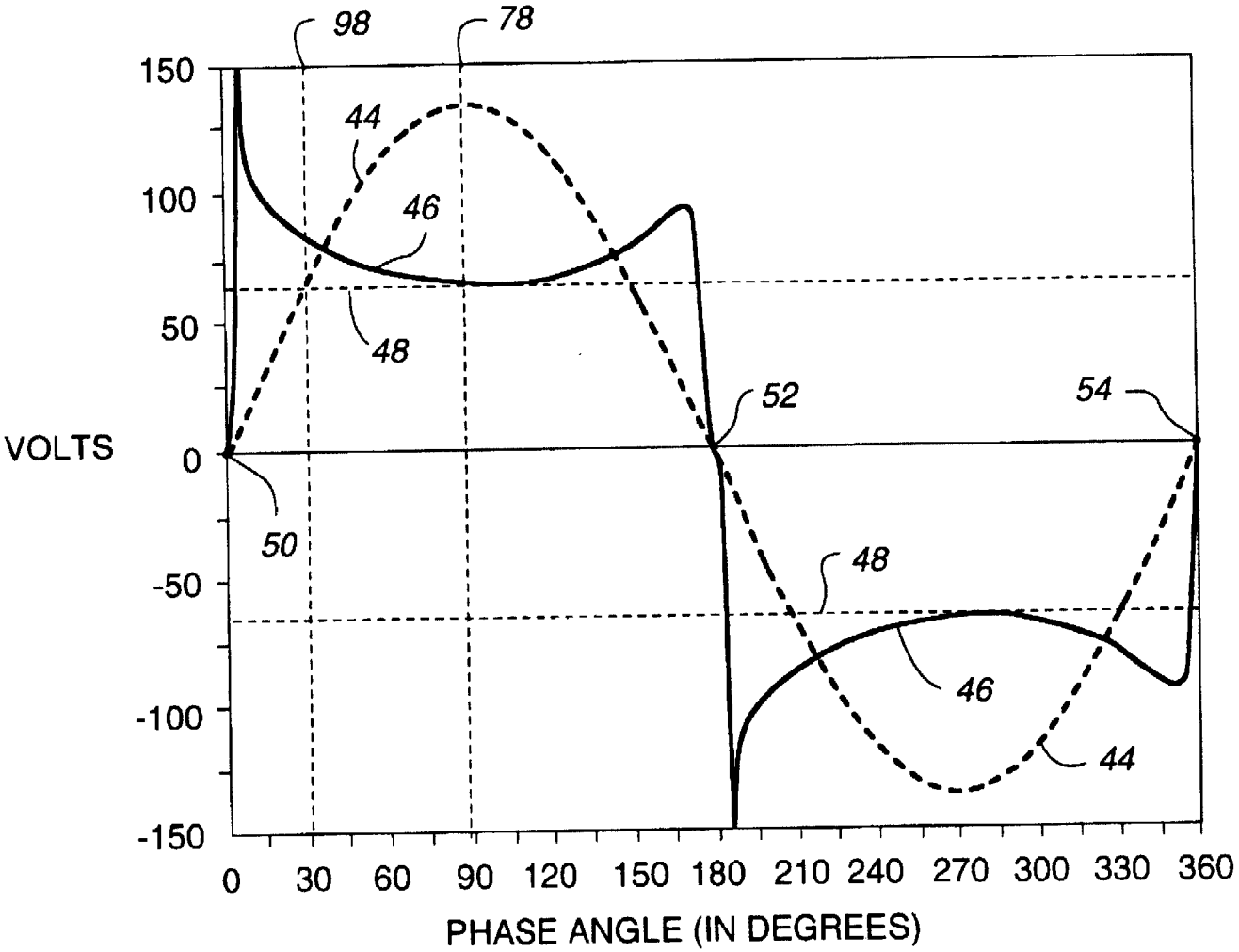
FIG. 2 is a diagram of the voltage waveforms appearing across the fluorescent lamp shown in FIG. 1 when the lamp is lit and unlit.

While the medium is non-ionized, the instantaneous voltage which appears across the cathodes 36 is represented by curve 44 in FIG. 2 and is substantially the same as the AC line voltage provided by the source 28. While the medium is ionized, the instantaneous voltage which appears across the cathodes 36 is represented by curve 46 in FIG. 2. The characteristic ionization voltage established by the ionized medium within the lamp is represented by the curve 48 shown in FIG. 2. Notice that the instantaneous voltage 46 while the medium is ionized generally parallels the characteristic ionization voltage 48. The current which flows through the ionized and ignited mercury medium also flows through the cathodes 36. The current continues to heat the cathodes and maintain the cathodes at a temperature adequate for continued operation. The heating assures that the lamp will ignite on a reliable basis between sequential half-cycles of power applied from the source 28.

Points 50, 52 and 54 shown in FIG. 2 represent the points where the AC voltage across the lamp 24 normally crosses the zero reference point represented by the horizontal axis in FIG. 2. The points 50, 52, and 54 thus represent the beginning and end of two consecutive half-cycles of applied AC line voltage. The illumination condition of the fluorescent lamp 24 represented by curve 46 in FIG. 2 illustrates that the ionized medium is excited to the characteristic ionization voltage 48 over almost the whole duration of each half-cycle, except for the relatively slight time intervals at the beginning and end of each half-cycle.

When the AC line voltage from the source 28 drops below a predetermined line voltage threshold above the characteristic ionization voltage of the medium, the medium cannot be sustained in an ionized state and the lamp 24 becomes unlit. Generally, the medium in fluorescent lamps will remain ionized when the peak amplitude of the AC line voltage from the source 28 is at least equal to twice the characteristic ionization voltage 48 of the medium. The lamp is generally in an lit state when the voltage across the cathodes exceeds the characteristic ionization voltage 48 by a lamp voltage threshold.

The controller 40 determines when the medium in the lamp 24 has become non-ionized due to a sag in the AC line voltage from the source 28, monitors the AC line voltage during the low voltage condition, and triggers the switching device 42 to restart the lamp 24 when the AC line voltage rises to a level that is sufficient to sustain ionization of the medium in the lamp 24. Preferably, the controller 40 comprises a microcontroller, or other logic circuit or state machine, that monitors the voltage across the cathodes 36 and controls the switching device 42 according to preprogrammed operations.

The controller 40 monitors the voltage across the cathodes 36 by monitoring the voltage present at a junction 62 in a voltage divider 60 that comprises a pair of resistors 64 and 66 connected in series between the terminals 35 and 37. The voltage divider 60 serves to reduce the amplitude of the voltage across the cathodes 36 to levels that are more suitable for monitoring by the controller 40.

The operations that are executed by the controller 40 for monitoring and restarting the lamp 24 are shown in FIG. 3. The controller 40 monitors the lamp 24 to determine when the lamp becomes unlit. In particular, beginning with the lamp 24 in a lit state, shown at 70, the controller 40 detects the zero crossing of a half cycle of the AC voltage across the cathodes 36, shown at 72. The controller 40 then samples the voltage across the cathodes 36 at a predetermined first sample time after the zero crossing point, shown at 74, and compares the sampled voltage to a first reference voltage proportional to the characteristic ionization voltage 48 of the medium to determine whether the lamp 24 has become unlit, shown at 76. Preferably, the first sample time is selected so that the sampled voltage across the cathodes 36 corresponds to the peak AC line voltage provided by the source 28. For a 60 Hz AC line voltage, the first sample time is about 4.16 milliseconds which corresponds to about a 90 degree phase angle (78, FIG. 2) after the zero crossing point (50, FIG. 2).

A threshold detect circuit (not specifically shown, but incorporated in the controller 40 shown in FIG. 1) is used to compare the sampled voltage against the first reference voltage which is generated by a conventional voltage reference circuit. Alternatively, the controller 40 can compare a reference voltage value to a sampled voltage value which is provided by one of the following: an analog-to-digital converter that generates a digital word indicative of the voltage across the cathodes 36; a voltage-to-frequency converter that generates an output voltage having a frequency that is proportional to the voltage across the cathodes; or a resistive and capacitive circuit that generates a signal having a time constant that is proportional to the voltage across the cathodes.

To improve the accuracy of the determination of the state of the lamp 24, the controller 40 repeats the determination of the state of the lamp 24 a predetermined number of times. Each time the controller determines that the lamp 24 is in a lit state, the controller 40 increments an internal "lit" counter, shown at 80. The controller 40 repeats the operations to monitor the lamp voltage, shown at 72–82, while clearing the "lit" counter and an internal "not-lit" counter after every four half cycles of the AC voltage in which the controller determines that the lamp 24 is lit, shown at 84.

When the controller 40 compares the sensed lamp voltage to the first reference voltage and determines that the lamp 24 is not lit, the controller 40 increments the internal "not-lit" counter, shown at 86, and repeats the operations to monitor the lamp voltage, shown at 72–86, until the "not-lit" counter exceeds about 46, shown at 88. The controller 40 then determines that the lamp 24 has transitioned from a lit state to an unlit state and sets a bit in an internal register (not specifically shown, but incorporated in the controller 40 shown in FIG. 1) to indicate that the lamp 24 is unlit, as shown at 90.

Once the controller 40 has determined that the lamp 24 has become unlit, the controller 40 then determines whether the lamp 24 has become unlit due to a sagging AC line voltage condition in which the source 28 is providing an insufficient AC line voltage to sustain ionization of the medium in the lamp 24. In particular, the controller 40 detects the zero crossing of a half cycle of the AC voltage across the cathodes 36, shown at 92. The controller 40 then samples the voltage across the cathodes 36 at a predetermined second sample time after the zero crossing point, shown at 94, and compares the sampled voltage to a second reference voltage that is proportional to the minimum line voltage from the source 28 that will sustain ionization of the medium, shown at 96. Since the lamp is unlit and, thereby, substantially nonconducting, the voltage sensed across the cathodes 36 is substantially the same as the AC line voltage provided by the source 28.

The controller 40 can use the same reference voltage for comparison with both the lamp voltage when the lamp is lit and the AC line voltage when the lamp is unlit (i.e., the controller can use the same values for the first and second reference voltages) by selecting the second sample time according to the following formula:

$$\text{SampleTime}=\text{Arcsine}(V_{ionization}/V_{Acpeak})/(180*(2*V_{freq}))$$

where:

SampleTime is the second predetermined sample time;

$V_{ionization}$ is the characteristic ionization voltage of the medium;

$V_{ACpeak}$ is a peak AC line voltage from the source 28 that is at least equal to the predetermined line voltage threshold above the characteristic ionization voltage of the medium which is sufficient to sustain ionization of the medium; and $V_{freq}$ is the frequency of the AC line voltage from the AC power supply.

For a peak AC line voltage which is twice the characteristic ionization voltage, and a 60 Hz AC line voltage from the supply 28, the AC line voltage from the source 28 can be measured across the cathodes 36 at an angle of 30 degrees and, correspondingly, at a second sample time of about 1.39 milliseconds (98, FIG. 2) after a zero crossing of a half cycle of the AC line voltage.

When the controller 40 compares the sampled AC line voltage to the reference voltage and determines there is sufficient line voltage to sustain ionization of the medium, the controller 40 determines that the lamp has become extinguished due to a condition other than a sagging AC line voltage from the source 28, such as due to a lamp failure, shown at 100. Consequently, the controller 40 does not restart the lamp 24 until the lamp circuit 22 is reset by a power interruption, such as by a cycling of a wall switch that controls the delivery of power from the source 28 to the lamp circuit 22.

If the controller 40 determines that the lamp 24 has become unlit due a sagging AC line voltage condition, the controller 40 then monitors the AC line voltage by waiting for a zero crossing point of the AC line voltage, shown at 102, sensing the AC line voltage at the predetermined second sample time, shown at 104, and comparing the sensed AC line voltage to the reference voltage, shown at 106. When the AC line voltage has risen to a level which is sufficient to sustain ionization of the medium (defined by the predetermined line voltage threshold above the characteristic ionization voltage), the controller 40 controls the switching device 42 to restart the lamp 24. In this manner, the lamp 24 is restarted only after the controller 40 determines that the conditions are such that the lamp 24 can remain lit after it is restarted.

A presently preferred embodiment of the invention and its improvements have been described with a degree of particularity. This description has been made by way of a preferred example. It should be understood that the scope of the present invention is defined by the following claims, and should not necessarily be limited by the detailed descriptions of the preferred embodiment set forth above.

The invention claimed is:

1. A control module for use with a fluorescent lamp having cathodes and a medium therebetween which is ionizable into a conductive plasma and which has a characteristic ionization voltage across the cathodes when the medium is ionized into the conductive plasma, the cathodes energized by an alternating (AC) power source which provides alternating half cycles of AC line voltage and AC line current to the cathodes, said control module adapted to be connected to the cathodes, said control module comprising:

a lamp monitoring circuit for determining whether the medium of the lamp is ionized into the conductive plasma;

a line voltage monitoring circuit for determining whether the AC line voltage from the AC power source is less than a predetermined line voltage threshold, the predetermined line voltage threshold being greater than the characteristic ionization voltage of the medium;

the lamp monitoring circuit activating the line voltage monitoring circuit in response to the lamp monitoring circuit determining that the medium is substantially non-ionized and non-conducting;

a starter circuit for generating a starting voltage pulse between the cathodes sufficient to ionize the medium into the conductive plasma which the AC line voltage which is at least equal to the predetermined line voltage threshold will sustain; and a starter initiation circuit connected to the lamp monitoring, line voltage monitoring and starter circuits, the starter initiation circuit triggering the starter circuit to generate the starting voltage pulse in response to (a) the lamp monitoring circuit determining that the medium is substantially non-ionized and non-conducting and (b) the line voltage monitoring circuit determining that the AC line voltage is at least equal to the predetermined line voltage threshold to enable the AC line voltage to sustain the medium in an ionized and conductive state after application of the starting pulse.

2. The control module as defined in claim 1, wherein the fluorescent lamp is connected to a ballast through which the AC power source supplies AC line current to the cathodes, and wherein with respect to said control module:

the starter circuit comprises a current switch device which selectively conducts the AC line current through the ballast and the cathodes when in a conductive condition and which ceases conducting the AC line current when commutated into a non-conductive condition to cause a change in the AC line current through the cathodes per change in time (di/dt) to generate the starting voltage pulse across the cathodes; and the starter initiation circuit commutates the current switch device between-the conductive condition and the non-conductive condition to generate the starting voltage pulse when the lamp monitoring circuit determines that the medium is substantially non-ionized and non-conductive and the line voltage monitoring circuit determines that the AC line voltage is at least equal to the predetermined line voltage threshold.

3. A control module for use with a fluorescent lamp having cathodes and a medium therebetween which is ionizable into a conductive plasma and which has a characteristic ionization voltage across the cathodes when the medium is ionized into the conductive plasma, the cathodes energized by an alternating (AC) power source which provides alternating half cycles of AC line voltage and AC line current to the cathodes, said control module adapted to be connected to the cathodes, said control module comprising:

a lamp monitoring circuit for determining whether the medium of the lamp is ionized into the conductive plasma;

a line voltage monitoring circuit for determining whether the AC line voltage from the AC power source is less than a predetermined line voltage threshold, the predetermined line voltage threshold being greater than the characteristic ionization voltage of the medium;

the lamp monitoring circuit activating the line voltage monitoring circuit in response to the lamp monitoring circuit determining that the medium is substantially non-ionized and non-conducting; and wherein:

the lamp monitoring circuit generates a transition signal indicative of the medium having transitioned from being ionized and conductive to being substantially non-ionized and non-conductive; and the line voltage monitoring circuit responds to the transition signal to determine whether the voltage across the cathodes is less than the predetermined line voltage threshold.

4. The control module as defined in claim 1, wherein:

the line voltage monitoring circuit further determining whether the medium has become substantially non-ionized and non-conductive due to a condition other than insufficient AC line voltage, in response to the respective determinations of the lamp monitoring circuit and the line voltage monitoring circuit that the medium is substantially non-ionized and that the AC line voltage is at least equal to the predetermined line voltage threshold.

5. A control module for use with a fluorescent lamp having cathodes and a medium therebetween which is ionizable into a conductive plasma and which has a characteristic ionization voltage across the cathodes when the medium is ionized into the conductive plasma, the cathodes energized by an alternating (AC) power source which provides alternating half cycles of AC line voltage and AC line current to the cathodes, said control module adapted to be connected to the cathodes, said control module comprising:

a lamp monitoring circuit for determining whether the medium of the lamp is ionized into the conductive plasma;

a line voltage monitoring circuit for determining whether the AC line voltage from the AC power source is less than a predetermined line voltage threshold, the predetermined line voltage threshold being greater than the characteristic ionization voltage of the medium;

the lamp monitoring circuit activating the line voltage monitoring circuit in response to the lamb monitoring circuit determining that the medium is substantially non-ionized and non-conducting; and wherein:

the lamp monitoring circuit determines that the medium is substantially non-ionized and non-conductive by sensing the voltage across the cathodes and determining that the sensed voltage across the cathodes exceeds a predetermined lamp voltage threshold, the predetermined lamp voltage threshold being greater than the characteristic ionization voltage and less than the predetermined line voltage threshold.

6. The control module as defined in claim 5, wherein:

the lamp monitoring circuit determines that the medium of the lamp is substantially non-ionized and non-conductive when the sensed voltage across the cathodes exceeds the predetermined lamp voltage threshold for a predetermined multiple number of half cycles of the AC voltage.

7. The control module as defined in claim 6, wherein:

the predetermined number of half cycles is at least 45.

8. A control module for use with a fluorescent lamp having cathodes and a medium therebetween which is ionizable into a conductive plasma and which has a characteristic ionization voltage across the cathodes when the medium is ionized into the conductive plasma, the cathodes energized by an alternating (AC) power source which provides alternating half cycles of AC line voltage and AC line current to the cathodes, said control module adapted to be connected to the cathodes, said control module comprising:

a lamp monitoring circuit for determining whether the medium of the lamp is ionized into the conductive plasma;

a line voltage monitoring circuit for determining whether the AC line voltage from the AC power source is less than a predetermined line voltage threshold, the predetermined line voltage threshold being greater than the characteristic ionization voltage of the medium;

the lamp monitoring circuit activating the line voltage monitoring circuit in response to the lamp monitoring circuit determining that the medium is substantially non-ionized and non-conducting; and wherein:

the lamp monitoring circuit samples the voltage across the cathodes at a first predetermined sample time after the zero crossing point of a half cycle of the AC line voltage and compares the sampled voltage to a first reference voltage to determine whether the medium is ionized and conductive; and the line voltage monitoring circuit samples the voltage across the cathodes at a second predetermined sample time after the zero crossing point of a half cycle of the AC line voltage and compares the sampled voltage to a second reference voltage to determine whether the AC line voltage is sufficient to sustain ionization of and coduction by the medium.

9. The control module as defined in claim 8, wherein:

the first reference voltage and the second reference voltage are substantially the same when the second predetermined sample time is determined according to the following formula:

$$\text{SampleTime}=\text{Arcsine}(V_{ionization}/V_{ACpeak})/(180*(2*V_{freq}))$$

wherein:

SampleTime is the second predetermined sample time;

$V_{ionization}$ is the characteristic ionization voltage of the medium;

$V_{ACpeak}$ is a peak AC line voltage from the AC power supply that is at least equal to the predetermined line voltage threshold above the characteristic ionization voltage of the medium, which is sufficient to sustain ionization of the medium; and $V_{freq}$ is the frequency of the AC line voltage from the AC power supply.

10. The control module as defined in claim 8, wherein:

the second predetermined sample time is about 1.39 milliseconds for a 60 Hz frequency of the AC line voltage from the AC power supply and is about 1.67 milliseconds for a 50 Hz frequency of the AC line voltage.

11. The control module as defined in claim 8, wherein:

the first predetermined sample time is about 4.17 milliseconds for a 60 Hz frequency of the AC line voltage from the AC power supply and is about 5.0 milliseconds for a 50 Hz frequency of the AC line voltage.

12. A method of controlling a fluorescent lamp having cathodes and a medium therebetween which is ionizable into a conductive plasma and which has a characteristic ionization voltage across the cathodes when the medium is ionized and conductive, the cathodes energized by an alternating (AC) power source which provides alternating half cycles of AC line voltage and AC line current to the cathodes, said method comprising the steps of:

determining whether the medium of the lamp is ionized and conductive;

determining, in response to the medium of the lamp being determined to be substantially non-ionized and non-conductive, whether the AC line voltage from the AC power source is less than a predetermined line voltage threshold greater than the characteristic ionization voltage of the medium; and in response to determining that the medium is substantially non-ionized and non-conductive and in response to determining that the AC line voltage is at least equal to the predetermined line voltage threshold, applying a starting voltage pulse across the cathodes sufficient to ionize the medium and ignite the medium into the conductive plasma when the AC line voltage across the cathodes is at least equal to the predetermined line voltage threshold to sustain the ionization of and conduction by the medium.

13. A method as defined in claim 12, wherein the step of determining whether the medium is ionized and conductive comprises the steps of:

sensing the voltage across the cathodes; and determining whether the voltage across the cathodes exceeds a predetermined lamp voltage threshold, the predetermined lamp voltage threshold being greater than the characteristic ionization voltage and less than the predetermined line voltage threshold.

14. A method as defined in claim 13, wherein the step of determining whether the medium is ionized further comprises the step of:

determining whether the voltage across the cathodes exceeds the predetermined lamp voltage threshold for a predetermined multiple number of half cycles of the AC line voltage.

15. A method of controlling a fluorescent lamp having cathodes and a medium therebetween which is ionizable into a conductive plasma and which has a characteristic ionization voltage across the cathodes when the medium is ionized and conductive, the cathodes energized by an alternating (AC) power source which provides alternating half cycles of AC line voltage and AC line current to the cathodes, said method comprising the steps of:

determining whether the medium of the lamp is ionized and conductive;

determining, in response to the medium of the lamp being determined to be substantially non-ionized and non-conductive, whether the AC line voltage from the AC power source is less than a predetermined line voltage threshold, the predetermined line voltage threshold being greater than the characteristic ionization voltage of the medium;

determining a first voltage across the cathodes at a first predetermined sample time after a zero crossing point of a half cycle of the AC line voltage;

comparing the first voltage to a first reference voltage which is related to the characteristic ionization voltage of the medium;

determining a second voltage across the cathodes at a second predetermined sample time after the zero crossing point of a half cycle of the AC line voltage; and comparing the second voltage to a second reference voltage which is related to the predetermined line voltage threshold.

16. A method as defined in claim 15, wherein the step of comparing the second voltage across the cathodes further comprises the step of:

calculating the second predetermined sampling time from the following equation so that the first reference voltage and the second reference voltage are substantially the same:

$$\text{SampleTime}=\text{Arcsine}(V_{ionization}/V_{Acpeak})/(180*(2*V_{freq}))$$

wherein:

SampleTime is the second predetermined sample time;

$V_{ionization}$ is the characteristic ionization voltage of the medium;

$V_{ACpeak}$ is a peak AC line voltage from the AC power supply that is at least equal to the predetermined line voltage threshold above the characteristic ionization voltage of the medium, which is sufficient to sustain ionization of the medium; and $V_{freq}$ is the frequency of the AC line voltage from the AC power supply.

17. A method as defined in claim 16, further comprising the steps of:

establishing the second predetermined sample time at about 1.39 milliseconds from the zero crossing point for a 60 Hz frequency of the AC line voltage; and establishing the second predetermined sample time at about 1.67 milliseconds from the zero crossing point for a 50 Hz frequency of the AC line voltage.

18. A method as defined in claim 16, further comprising the steps of:

establishing the first predetermined sample time at about 4.17 milliseconds from the zero crossing point for a 60 Hz frequency of the AC line voltage; and establishing the first predetermined sample time at about 5.0 milliseconds from the zero crossing point for a 50 Hz frequency of the AC line voltage.

19. A method as defined in claim 12, further comprising the step of:

determining whether the medium has become substantially non-ionized and non-conductive due to a condition other than insufficient AC line voltage, in response to the respective steps of determining whether the medium is substantially non-ionized and whether the AC line voltage is at least equal to the predetermined line voltage threshold.

20. A method as defined in claim 14, further comprising the step of:

establishing the predetermined number of half cycles to be at least 45.

* * * * *